US006662744B2

(12) United States Patent
Wallhouse

(10) Patent No.: US 6,662,744 B2
(45) Date of Patent: Dec. 16, 2003

(54) PORTABLE ACCIDENT MARKING SYSTEM

(75) Inventor: Blair D Wallhouse, Toronto (CA)

(73) Assignee: Blair Wallhouse, Toronto (CA)

( * ) Notice: Subject to any disclaimer, the term of this patent is extended or adjusted under 35 U.S.C. 154(b) by 0 days.

(21) Appl. No.: 10/284,823

(22) Filed: Nov. 1, 2002

(65) Prior Publication Data

US 2003/0094126 A1 May 22, 2003

(30) Foreign Application Priority Data

Nov. 21, 2001 (CA) ..... 2363966

(51) Int. Cl.[7] ..... G09F 7/18; G09F 7/02

(52) U.S. Cl. ..... 116/209; 40/299.01; 40/607.13; 116/200

(58) Field of Search ..... 116/209, 200, 116/1, 280, 306, DIG. 1; 40/299.01, 607.13, 611.01; 24/482; 441/74; 150/154, 165

(56) References Cited

U.S. PATENT DOCUMENTS 1,871,570 A * 8/1932 Weber ..... 52/3
2,998,695 A * 9/1961 Cornett ..... 368/282
3,022,808 A * 2/1962 Silver ..... 150/154
4,219,218 A * 8/1980 Waldon ..... 280/770
D278,467 S * 4/1985 Lang ..... D30/35
4,674,787 A * 6/1987 DeVera ..... 294/147
5,000,482 A * 3/1991 Cimino ..... 280/809
5,022,678 A * 6/1991 Mayfield ..... 280/815
5,207,323 A * 5/1993 McConnell ..... 206/315.1
5,553,733 A * 9/1996 Rosenthal ..... 428/35.2
5,655,272 A * 8/1997 Young ..... 24/482
5,697,128 A * 12/1997 Peregrine ..... 24/115 G
5,823,684 A * 10/1998 Valeri ..... 383/119
5,891,537 A * 4/1999 Yoshii et al. ..... 428/35.2
5,967,314 A * 10/1999 McGovern ..... 206/315.1
6,202,263 B1 * 3/2001 Harker ..... 24/300
6,271,667 B1 * 8/2001 Minarovic ..... 324/326

* cited by examiner

*Primary Examiner*—Diego Gutierrez
*Assistant Examiner*—R. Alexander Smith

(57) ABSTRACT

A portable accident marking system to be used in conjunction with a rigid structure such as a snowboard, skis or the like, in order to alert others of an accident. The system is pliable so that when not in use it can easily fold and fit into a small pocket. The system includes a main body, cords or elastic bands, and two opposing end caps wherein the cords attach the end caps to the main body. Each end cap includes a pocket which captures the tip or tail of a snowboard. Retainer clips are then used with each cord to adjust the fit of the system. Bright colours, reflective material, and indicia are used to make the system highly visible.

11 Claims, 6 Drawing Sheets

PORTABLE ACCIDENT MARKING SYSTEM

BACKGROUND OF THE INVENTION

Each year ski patrollers and other first responders at ski resorts have to deal with the after math of an accident. While tending to the primary incident, it is not uncommon to have other resort patrons ski or "slide" into the patient and medical personnel. This is commonly due to the accident not being clearly marked or the guest not recognizing the pending hazard. There exists a need for a portable accident marking system that can be utilized by first responders to warn others of an accident or other potential hazards.

The portable accident marking system needs to light weight, portable, pose no risk to the carrier and highly visible in all weather conditions. This is accomplished by using a "cloth" like material that is bright in colour and has reflective properties. It does not contain any rigid members and is completely collapsible.

SUMMARY OF THE INVENTION

It is therefore a first advantage of the invention to address the shortcomings of the currently available accident marking systems by providing a safety apparatus that is compatible with available snow recreational equipment. This device is made of a pliable material that can easily fold and fit into a small pocket and does not pose a threat to the carrier if it falls. The device uses a snowboard, skis or the like as the frame work to give the unit structure unlike other available accident markers which have integral unremovable rigid members that are of metal or hard plastic. The marker is easily and quickly applied and does not require time consuming setup nor does it pose a fire hazard.

It is a second advantage of the invention to provide the user with a brightly coloured material that may or may not have reflective properties and is highly visible in all weather conditions. It could contain writing or other symbols to aide in its effectiveness.

It is a third advantage of the invention to provide a marker that can be setup using the carrier's snowboard, skis or the like. This enables the device to be deployed any where on a hill and be adjusted to provide maximum visibility to those who are approaching.

BRIEF DESCRIPTION OF THE DRAWINGS

The aforementioned advantages of the invention as well as additional advantages thereof will be more clearly understood hereinafter as a result of a detailed description of a preferred embodiment of the invention when taken in conjunction with the following drawings in which.

DETAILED DESCRIPTION OF THE INVENTION

This invention relates to a portable accident marking system used in conjunction with a snowboard, skis or the like, to alert others to an accident. Generally, accident marking systems consist of an apparatus that has to carried by rescue workers or sport enthusiasts. This apparatus usually incorporates rigid components that when carried are inconvenient and possibly dangerous and often necessitate time-consuming assembly. The system of the present invention is simple and has no rigid components and can be installed quickly and conveniently. This invention relates to a portable marking system for use in conjunction with a snowboard, skis or other rigid apparatus comprising: (a) at least one positioning means to be attached to an extremity of the apparatus, (b) a main attention attracting body attached to said positioning means, (c) a second means for securing said main body to a portion of the rigid apparatus remote from said first extremity.

A preferred embodiment of this invention is described as follows.

Figure 1:
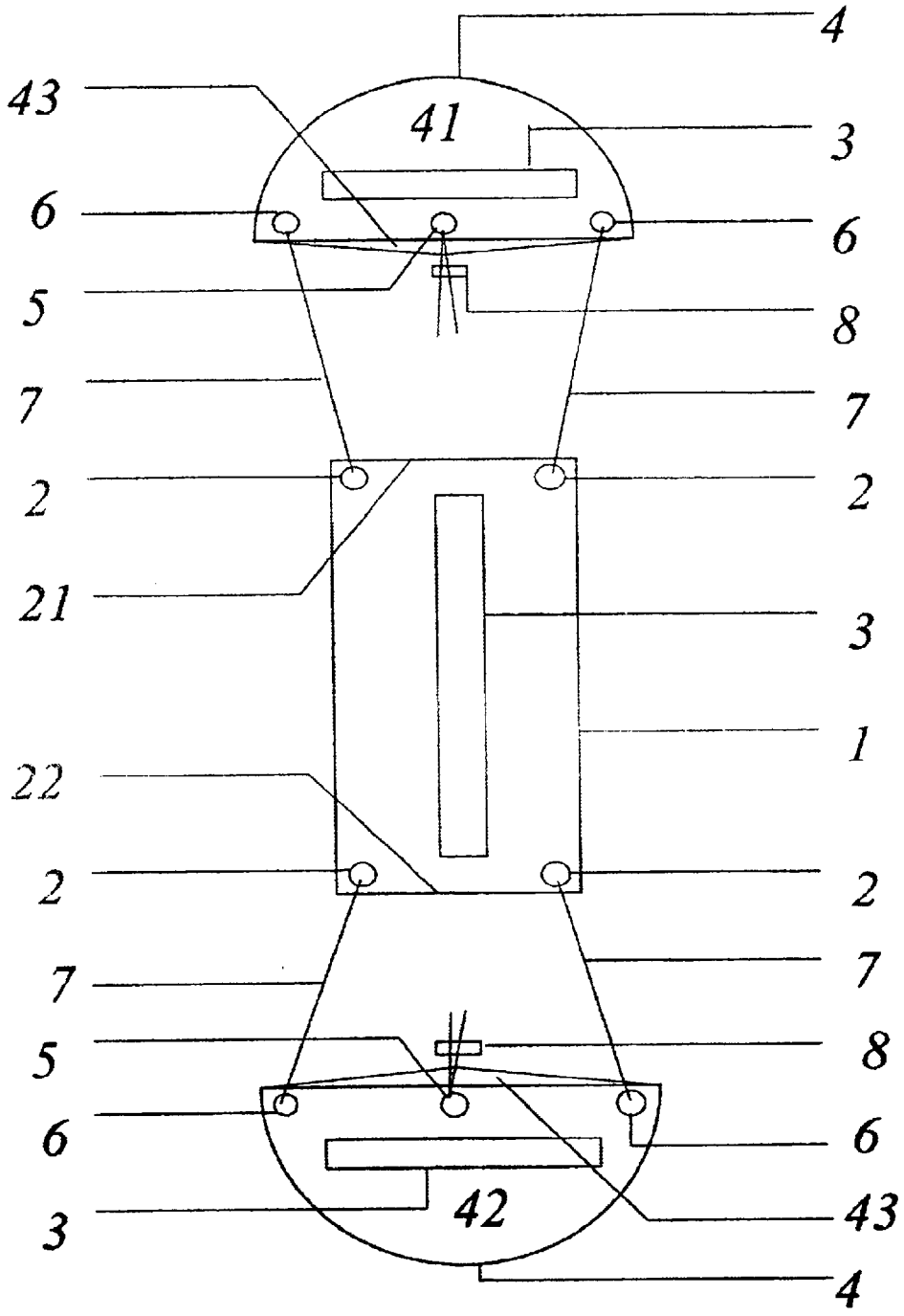
FIG. 1 is an overall view of the invention.
Figure 2:
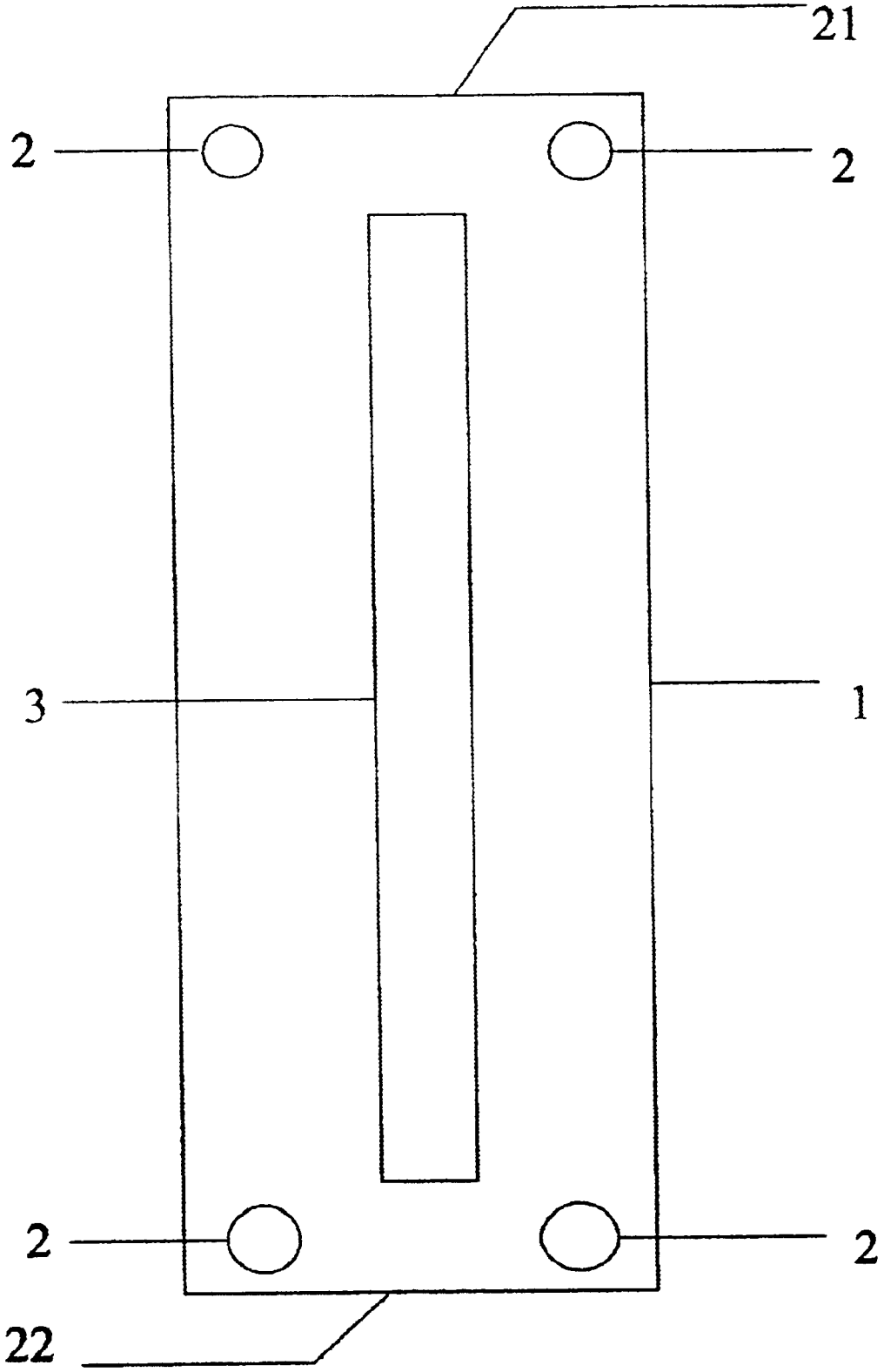
FIG. 2 is a enlarged view of the "Main Body" marked as (1)
Figure 3:
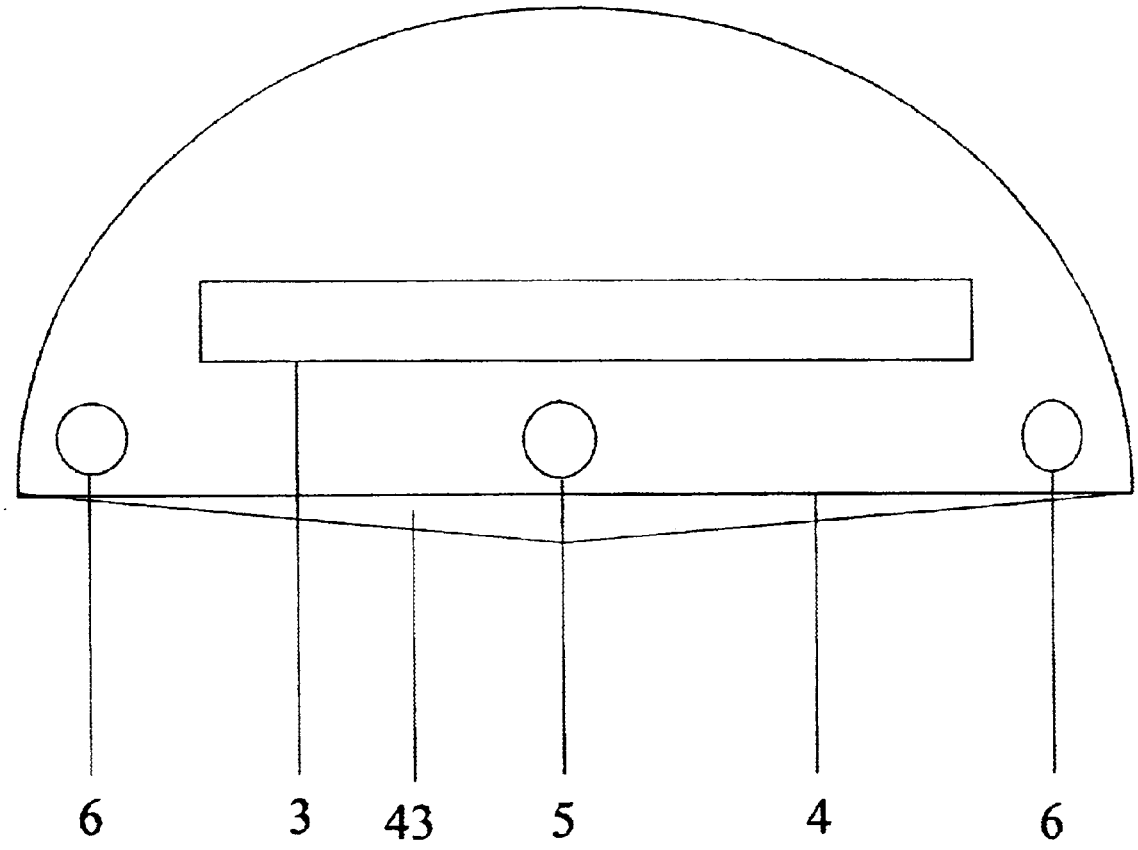
FIG. 3 is a enlarged view of the "End Caps" marked as (4)
Figure 4:
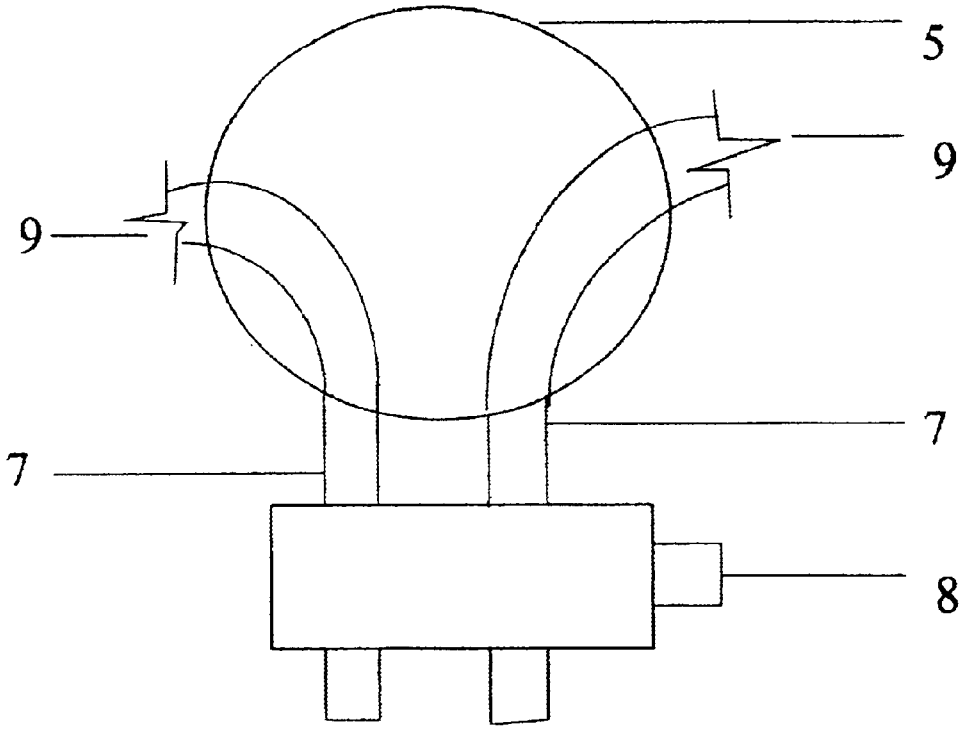
FIG. 4 is a enlarged view of the "Centre" grommet and other components marked as (5)
Figure 5:
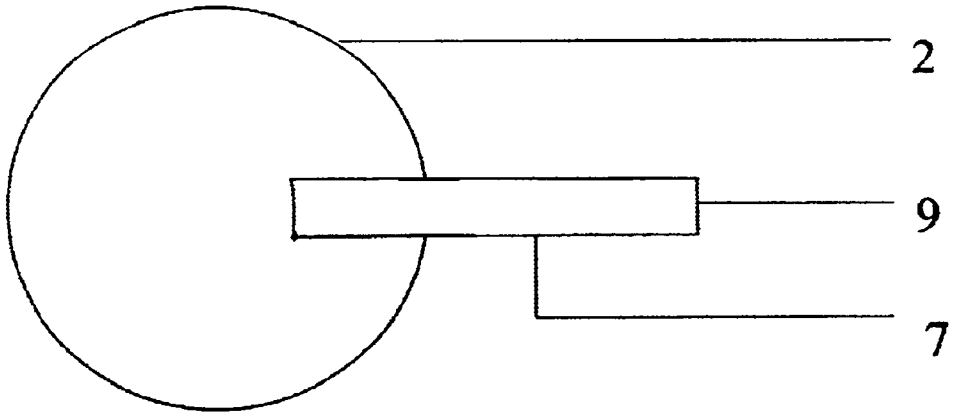
FIG. 5 is a enlarged view of the "Comer" grommets marked as (2)
Figure 6:
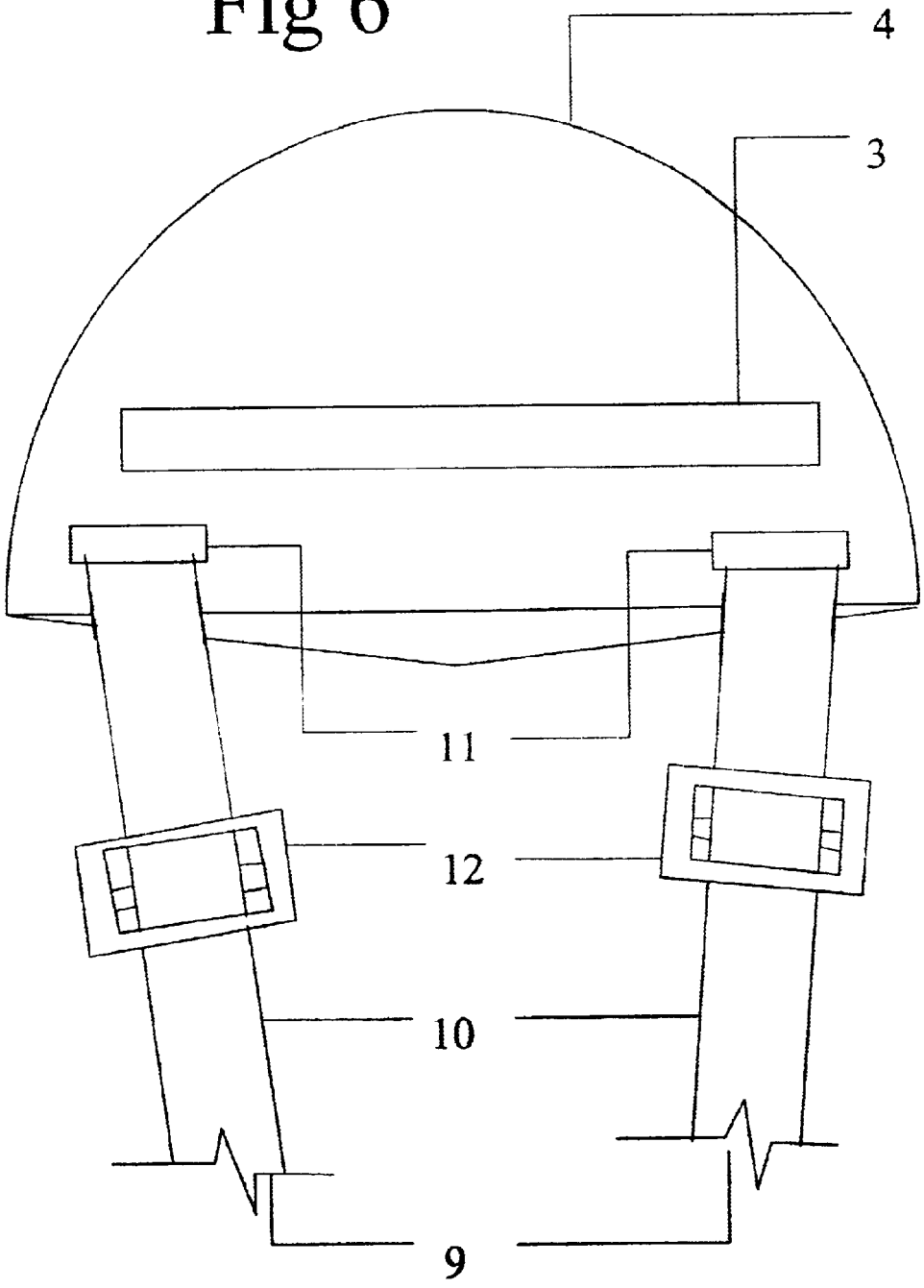
FIG. 6 shows an alternative embodiment for adjustably attaching the "End Caps"
Figure 7:
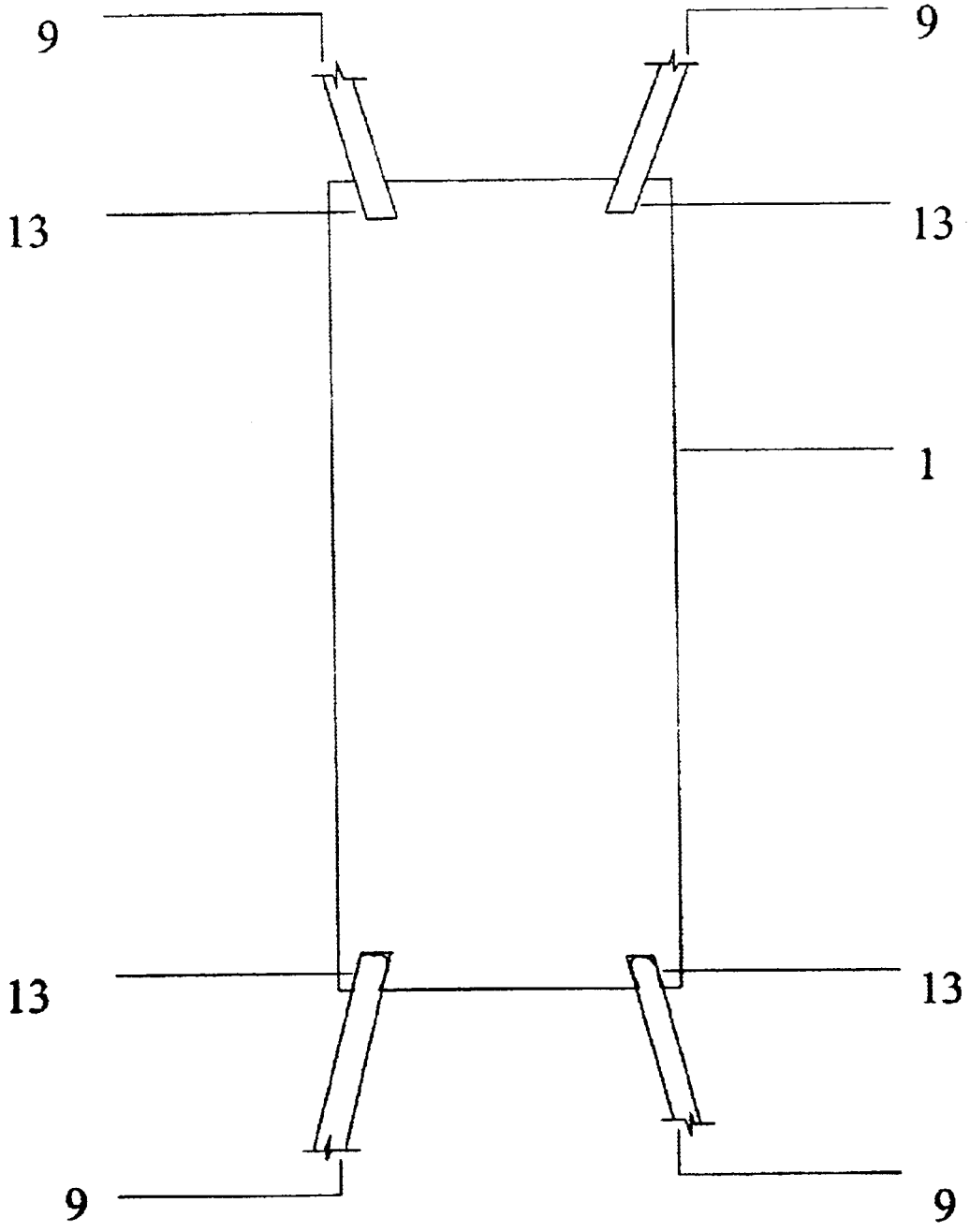
FIG. 7 shows an alternative embodiment for attaching the cord to "Main Body".

In the following diagrams of the invention, FIG. 1 is a front elevation. FIG. 2 is a large view of the main body panel. FIG. 3 is a large view of the end caps. FIG. 4 is an enlarged view of a centre grommet and elastic cord with an adjusting clip. FIG. 5 is an enlarged view of one main body grommet with a terminated elastic cord. FIG. 6 is an alternative method of constructing end caps along with a different elastic cording and adjusting clips. FIG. 7 is an alternative method of attaching the main body to the end caps.

The accident marking system illustrated is highly visible and fully adjustable to accommodate any snowboard. The majority of the system is made of a brightly coloured cloth and has three main components. The first being the main body 1 and the two end caps 4. The end caps 4 are half circles stitched along the arch and have openings at the diameter. This opening forms a pocket 43 in which the tip and tail rest. These three parts are connected using an elastic cording 7. One utilizes the system by applying a first end cap 41 onto the tip or tail and stretching the unit until the second end cap 42 can be fitted onto the remaining tip or tail. The snowboard acts as the main support and gives the apparatus the optimal viewing angle. To tighten the marking system one pulls the cord 7 through the grommet 5 and brings the retaining clip 8 to the surface of the centre grommet 5.

In FIG. 2, the main body 1 is a large hemmed piece of material. Reflective banding 3 is applied to the centre of the main body 1 and four grommets 2 are applied to the corners. Two of the four grommets are respectively applied to the two corners of the first side 21 of the main body and the remaining two grommets are respectively applied to the two corners of the second side 22 of the main body. Each of the cords 7 is respectively terminated at the four grommets 2 but runs through the corresponding grommets 6 and 5 as shown in FIG. 1. After the cord 7 meets at the grommet 5 as shown in FIG. 4, it is pulled through and a retaining clip 8 is applied. The retaining clip 8 facilitates the adjusting of the marking system and holds the cord taught.

In FIG. 3, the two end caps 4 incorporate the large stitched pockets 43 where the tip and tail are inserted. The end caps 4 have a piece of reflective banding 3 applied near the diameter or the opening. The elastic cording 7 runs freely through grommets 6 and 5.

FIG. 4 is an expanded view of the grommet 5. At the grommet 5, the ends of the cord come through and a retaining clip 8 is applied. The clip 8 allows one to contract and expand the overall system. Number 9 in FIGS. 4, 5, 6 and 7 represents the continuation of the elastic cording 7.

FIG. 5 is an enlarged view of the grommets 2 on the main body. The cord 7 is terminated at the grommet 2.

FIGS. 6 and 7 are an alternative method for attaching the end caps 4 to the main body 1. The same method for applying the system remains but the cording 10 and retaining clips 12 are different. The elastic cording 10 is a stretchy band which threads through a reinforced opening 11 near the opening and sides of the end caps. The cord 10 is then attached to a sliding retaining clip 12 to allow one to adjust the size of the accident marking system. In FIG. 7, the banding or cording 13 is stitched onto the corners of the main body 1 after the clips have been applied. The main body 1 in this case, is made of a solid reflective material with the possibility of applied lettering. Otherwise, all construction and application methods remain the same.

The foregoing are descriptions of the same preferred embodiments of the invention and do not limit the manner in which the objects of the invention can be accomplished.

What is claimed is:

1. A portable marking system for use in conjunction with a snowboard, skis or other rigid apparatus, said system comprising:

a main attention attracting body having a first side and an opposite second side, each of the sides having two corners, said main body being of a pliable and foldable material wherein said material is a reflective material or includes reflective banding, a first end cap and a second end cap, each of said end caps being of a pliable and foldable material with a pocket formed therein and having at least two openings, said two openings of each said end cap being spaced apart and located adjacent the mouth of the corresponding pocket, two cords wherein each is attached to one of the corners of said first side of the main body and wherein each of the two cords respectively and adjustably attaches to one of said openings of said first end cap, two additional cords wherein each is attached to one of the corners of said second side of the main body and wherein each of the two additional cords respectively and adjustably attaches to one of said openings of said second end cap, wherein each of the four cords is threaded through the corresponding opening of the corresponding end cap, and is attached to a retaining clip which allows the size of of the portable marking system to be adjusted.

2. The system of claim 1 wherein the main body includes indicia, lettering or symbols.

3. The system of claim 1 wherein the material of the main body is made of fabric.

4. The system of claim 1 wherein the material of the main body is elastic.

5. The system of claim 1 wherein each of the corners of the main body include grommets for attaching the corresponding cord.

6. The system of claim 1 wherein each of the corners of the main body are sewingly attached to the corresponding cord.

7. The system of claim 1 wherein the material of the first end cap and the second end cap is made of fabric.

8. The system of claim 1 wherein at least one of said end caps includes reflective banding.

9. The system of claim 1 wherein each of the openings of the end caps includes grommets or reinforcement.

10. The system of claim 1 comprising a center grommet located between the two corresponding openings of each said end cap, wherein the two cords associated with the first side and the first end cap are further threaded through the center grommet of the first end cap and attached together by the corresponding retaining clip, and wherein the two additional cords associated with the second side and the second end cap are further threaded through the center grommet of the second end cap and attached together by the corresponding retaining clip.

11. The system of claim 1 wherein each of the cords is an elastic band.

* * * * *